US008708407B2

(12) United States Patent
Marino

(10) Patent No.: US 8,708,407 B2
(45) Date of Patent: Apr. 29, 2014

(54) GOLF BAG STOOL

(76) Inventor: Thomas M. Marino, Garden City, NY (US)

( * ) Notice: Subject to any disclaimer, the term of this patent is extended or adjusted under 35 U.S.C. 154(b) by 228 days.

(21) Appl. No.: 13/506,183

(22) Filed: Apr. 2, 2012

(65) Prior Publication Data

US 2012/0256453 A1 Oct. 11, 2012

Related U.S. Application Data

(63) Continuation-in-part of application No. 29/395,120, filed on Nov. 29, 2011, which is a continuation-in-part of application No. 29/349,218, filed on Mar. 18, 2010, now abandoned.

(51) Int. Cl.
*A47C 7/62* (2006.01)
*A47C 9/00* (2006.01)

(52) U.S. Cl.
USPC ..... 297/188.08; 297/344.18; 297/344.19

(58) Field of Classification Search
USPC ..... 297/188.08, 344.12, 344.18, 344.19; D06/345, 351, 364
See application file for complete search history.

(56) References Cited

U.S. PATENT DOCUMENTS

| | | | | | |
|---|---|---|---|---|---|
| 4,988,117 | A * | 1/1991 | Shortall | 280/646 |
| D371,682 | S * | 7/1996 | Collings | D6/351 |
| 5,873,628 | A * | 2/1999 | Allard et al. | 297/326 |
| 5,908,132 | A * | 6/1999 | Pigeon | 220/484 |
| 5,967,408 | A * | 10/1999 | Garabedian | 236/44 R |
| 6,273,250 | B1 * | 8/2001 | Wu | 206/315.3 |
| 6,467,843 | B1 * | 10/2002 | Rossborough | 297/344.18 |
| D465,675 | S * | 11/2002 | Bloch et al. | D6/451 |
| D557,023 | S * | 12/2007 | Baughman | D6/351 |
| 8,136,876 | B2 * | 3/2012 | Bellvis Castillo et al. | 297/195.11 |
| 2003/0164633 | A1 * | 9/2003 | Jakus et al. | 297/271.5 |
| 2007/0138850 | A1 * | 6/2007 | Oettinger | 297/271.5 |

* cited by examiner

*Primary Examiner* — Philip Gabler

(57) ABSTRACT

A golf bag stool is provided for comfortable seating at locations where golf if played, or where users would like to be reminded of the game of golf. The golf bag stool has a small or miniature sized golf bag, a base, a central vertical column comprised of a pneumatic device and a seat such that the stool can be conveniently used for seating at conventional tables and countertops. The device permits the user to rotate universally in any 360 degree direction and to tip the golf bag stool toward or away from center, while still maintaining axial alignment between the vertical column and the golf bag structure. The golf bag stool can be adapted to display a wide array of insignia to remind the user of, e.g., a favorite team, tournament, university or golfer.

6 Claims, 8 Drawing Sheets

GOLF BAG STOOL

This application is a continuation-in-part of U.S. Design patent application Ser. No. 29/395,120, filed Nov. 29, 2011, which in turn is a continuation in part of U.S. Design patent application Ser. No. 29/349,218, filed Mar. 18, 2010 now abandoned.

BACKGROUND OF THE INVENTION

1. Field of the Invention

This invention relates to a stool useful in association with the game of golf, and more particularly to a golf bag stool.

2. Description of Related Art

Golf is a game requiring both skill and concentration. Oftentimes, weekend golfers need to be reminded that golf is a game intended for fun and relaxation. When golfers have completed a round of golf it is not uncommon for golfers to gather with others to discuss the day's game, usually while enjoying food and beverage. Chairs or stools in the golf clubhouse typically match the décor of the clubhouse rather than provide specific identity to the game of golf. One attempt to provide a chair or stool having an identity to golf is described in U.S. Design Pat. No. 557,023. In that patent, a golf bag stool is disclosed wherein a golf bag is used as a seat. Unfortunately, golf bags are typically tall and bulky. Sitting atop a conventional golf bag would be very difficult and perhaps even dangerous in requiring one to leap atop a golf bag in order to be seated. According to the design of the '023 patent, a step is provided for the purpose of enabling the golfer to climb atop the tall bag. Unfortunately, incorporating a step in a golf bag would be difficult and cumbersome since golf bags are not made for such purpose. Moreover, modification to add a step would be costly and, even if accomplished, would not produce a very functional stool. The overall height of the average golf bag is too high to enable a person to sit atop the bag and still be conveniently situated for eating or drinking at a table or countertop.

Accordingly, it would be highly desirable to provide a stool that could be used in association with the game of golf, golf facilities, or in locations where individuals enjoy golf, or would like to be reminded of golf while relaxing and perhaps enjoying food or beverage, e.g., in one's home or club. Another object of the invention is to provide a stool having a miniature sized golf bag at the base thereof which, while providing the golfer with a pleasant reminder of the game of golf, does so in a manner that provides comfortable seating at, e.g., tables or countertops. It would also be highly desirable to provide a golf bag stool having a comfortable seat capable of rotating independent of the golf bag itself, so that the user could freely move around without shifting the golf bag. It would also be desirable to provide a golf bag stool that could provide soft and cushioned seating and simultaneously permit tilting or leaning in every circumferential direction so that persons sitting on the stool could comfortably lean and turn toward one another, or toward a table top or countertop, to enjoy additional comfort and relaxation. It would also be highly desirable to provide a golf bag stool that can be made with different types of miniature golf bags having insignia, thereon so that different stools could be provided, with different names, organizations and logos, depending upon different preferences and markets.

SUMMARY OF THE INVENTION

A golf bag stool is provided comprising a base having a top portion, a flat bottom portion, upwardly tapered sides and an outer perimeter. The top portion of the base has a central opening. The bottom portion has an inner perimeter, with the upwardly tapered sides extending from the inner perimeter to the other perimeter of the base. A central vertical column is provided having approximately the same cross sectional dimension as the central opening in the top portion of the base so that the central vertical column fits into the base via a friction fit. A miniature golf bag is provided having a bottom cover and a top cover, with the bottom cover and the top cover each having central openings. The central vertical column extends through the central opening of the bottom cover of the miniature golf bag and through the central opening of the top cover of the miniature golf bag so that the miniature golf bag is positioned to surround the central vertical column, with the central vertical column positioned along a longitudinal central axis of the miniature golf bag. The central vertical column is comprised of a pneumatic device having a top vertical column portion pneumatically fitting into a bottom vertical column portion. The bottom cover of the miniature golf bag is positioned immediately above the base, and a seat is provided attached to the top vertical column portion of the central vertical column. The golf bag stool can have the central vertical column, the central opening in the top portion of the base, the central opening of the bottom cover and the central opening of the top cover of the miniature golf bag all being circular. The golf bag stool can also have the inner perimeter of the flat bottom portion of the bass being circular, the outer perimeter of the base being circular and the upwardly tapered sides extending from the inner perimeter of the flat bottom portion of the base to the outer perimeter of the base so that the golf bag stool can tip in any circumferential direction while still maintaining the miniature golf bag and the central vertical column in axial alignment. The top vertical column portion of the central vertical column can rotate 360° in the bottom vertical column portion of the central vertical column. The base can also be provided with a frictional member at the bottom thereof to reduce unwanted slipping.

DESCRIPTION OF THE INVENTION

Figure 1:
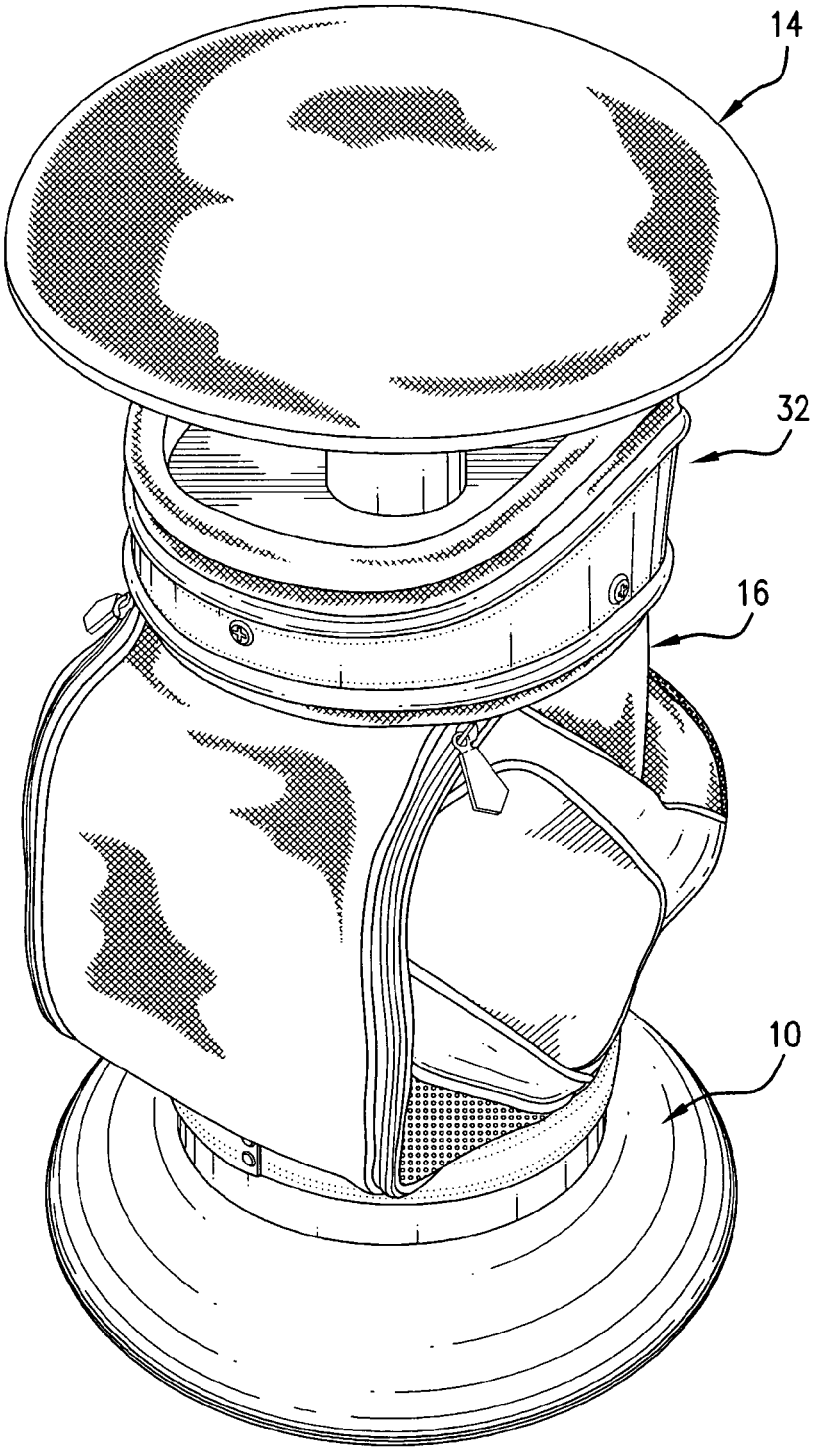
FIG. 1 is a perspective view of the Golf Bag Stool of the invention.
Figure 2:
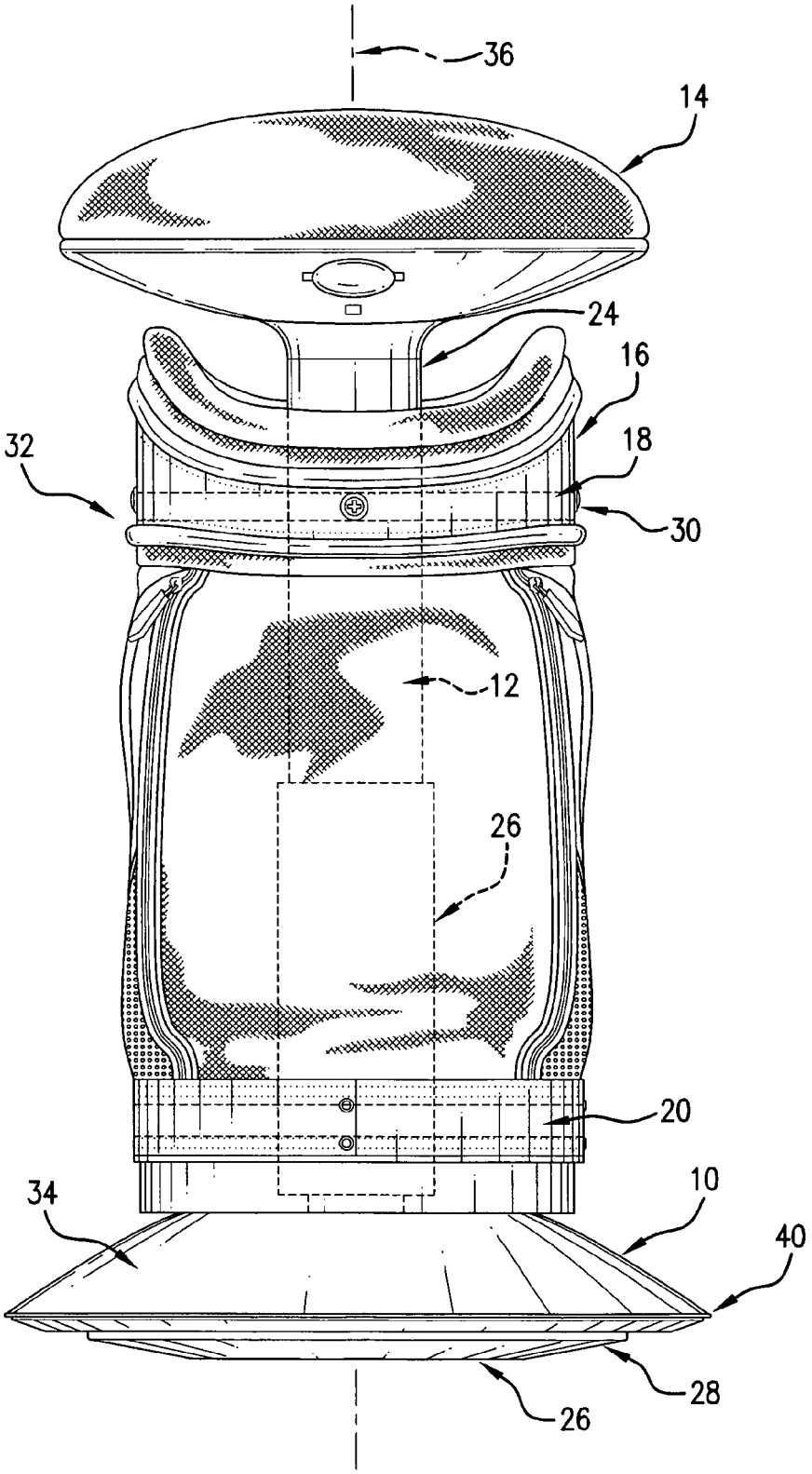
FIG. 2 is a front plan view of the Golf Bag Stool of FIG. 1.
Figure 3:
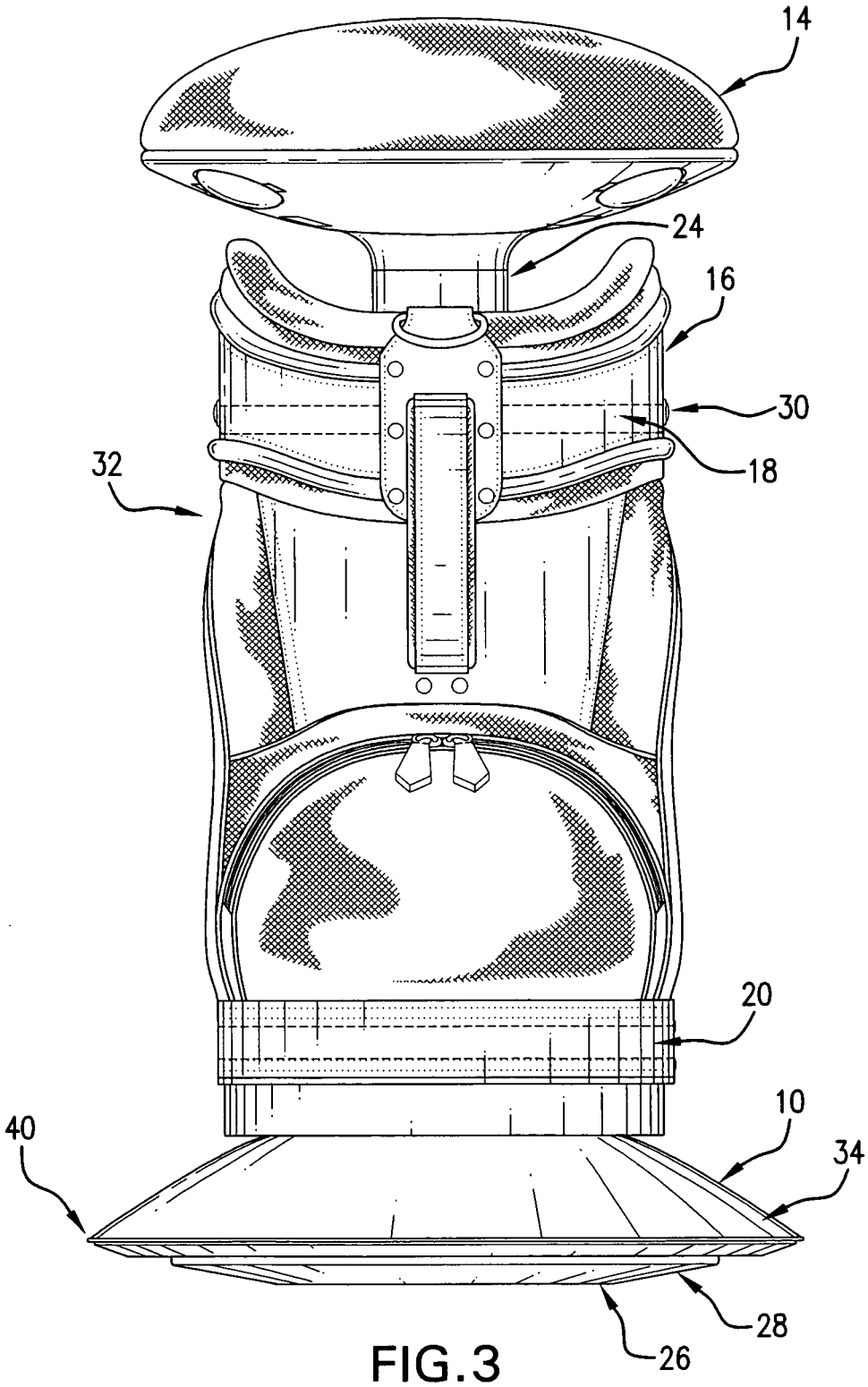
FIG. 3 is a back plan view of the Golf Bag Stool of FIG. 1.
Figure 4:
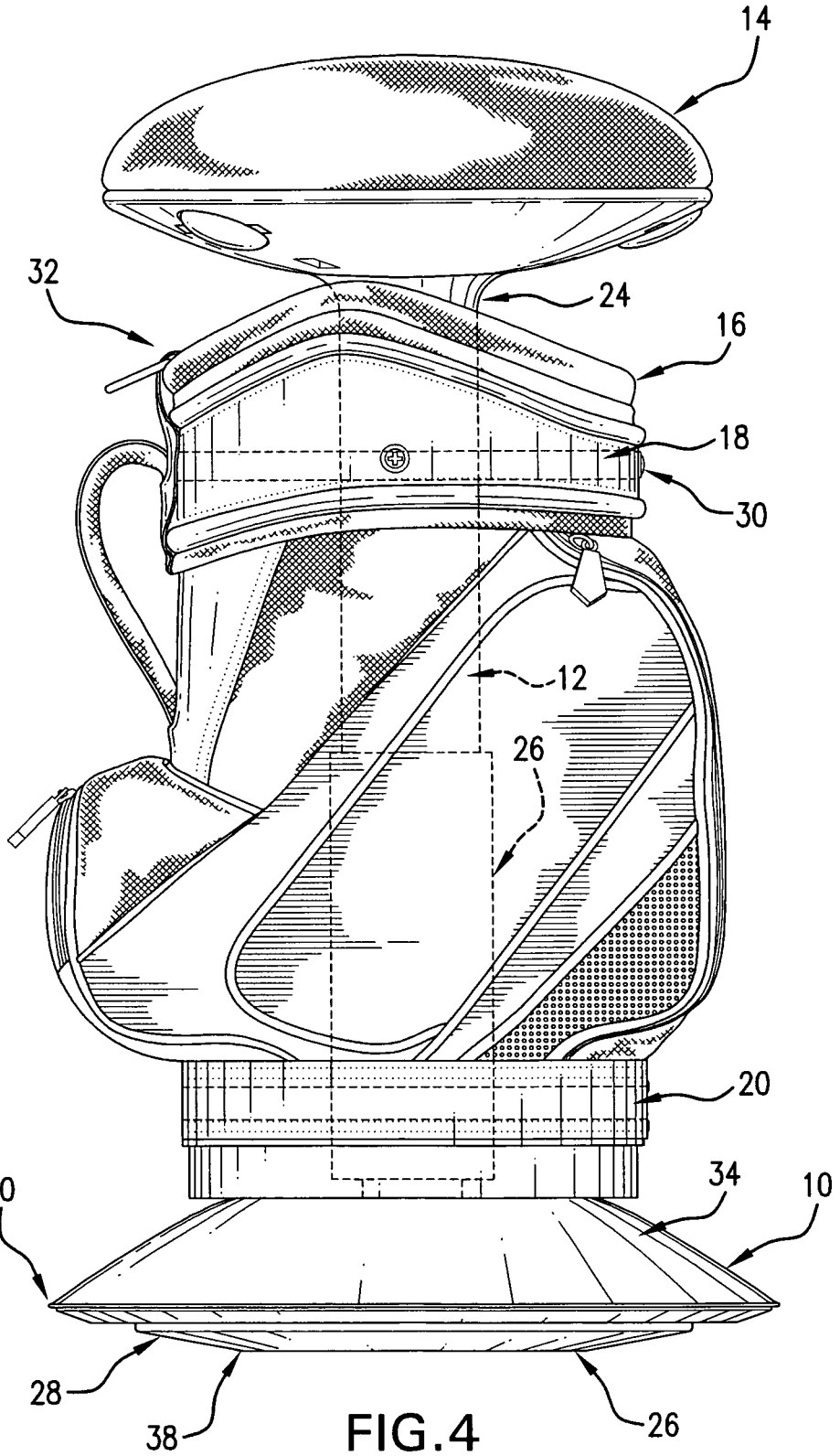
FIG. 4 is a left plan view of the Golf Bag Stool of FIG. 1.
Figure 5:
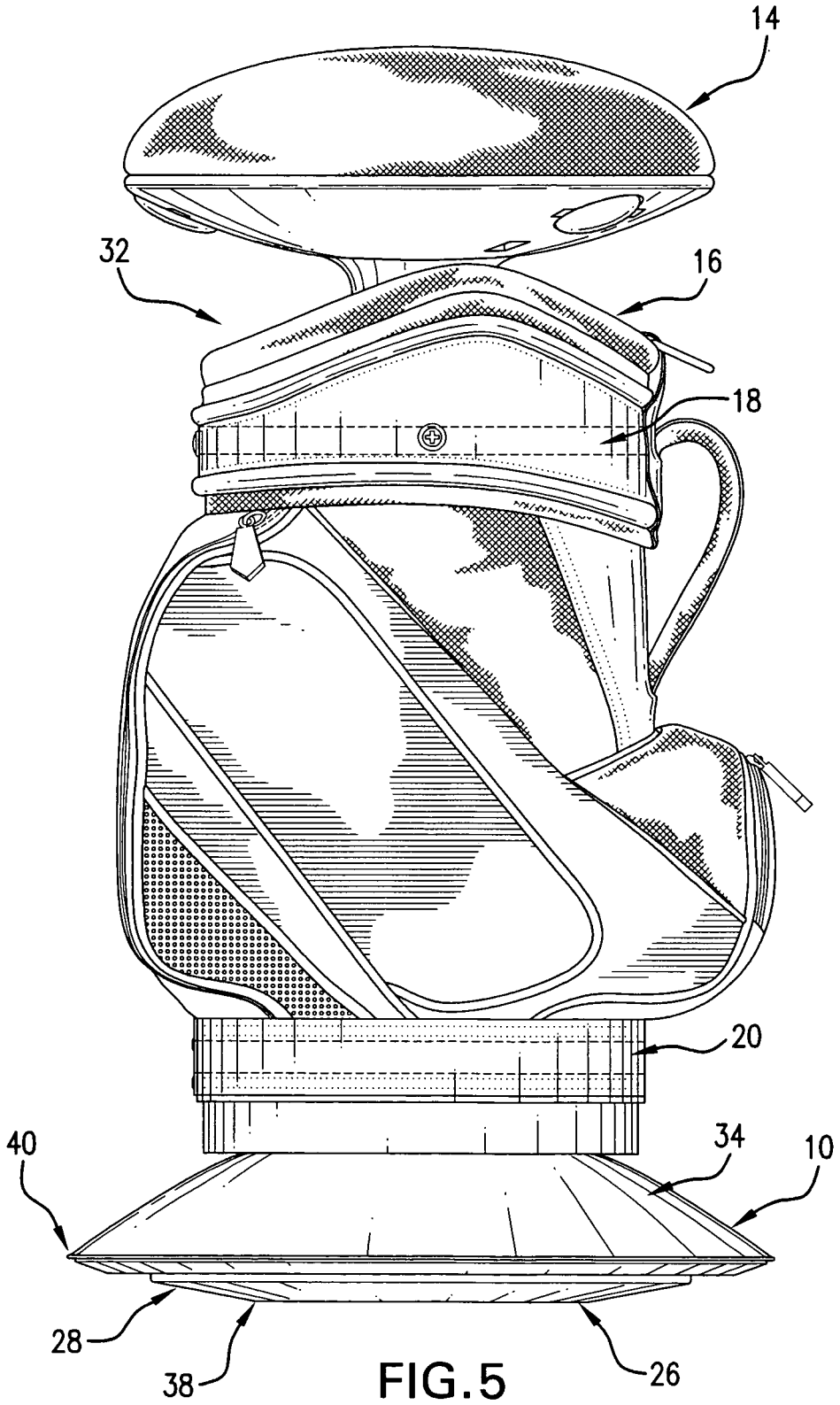
FIG. 5 is a right plan view of the Golf Bag Stool of FIG. 1.
Figure 6:
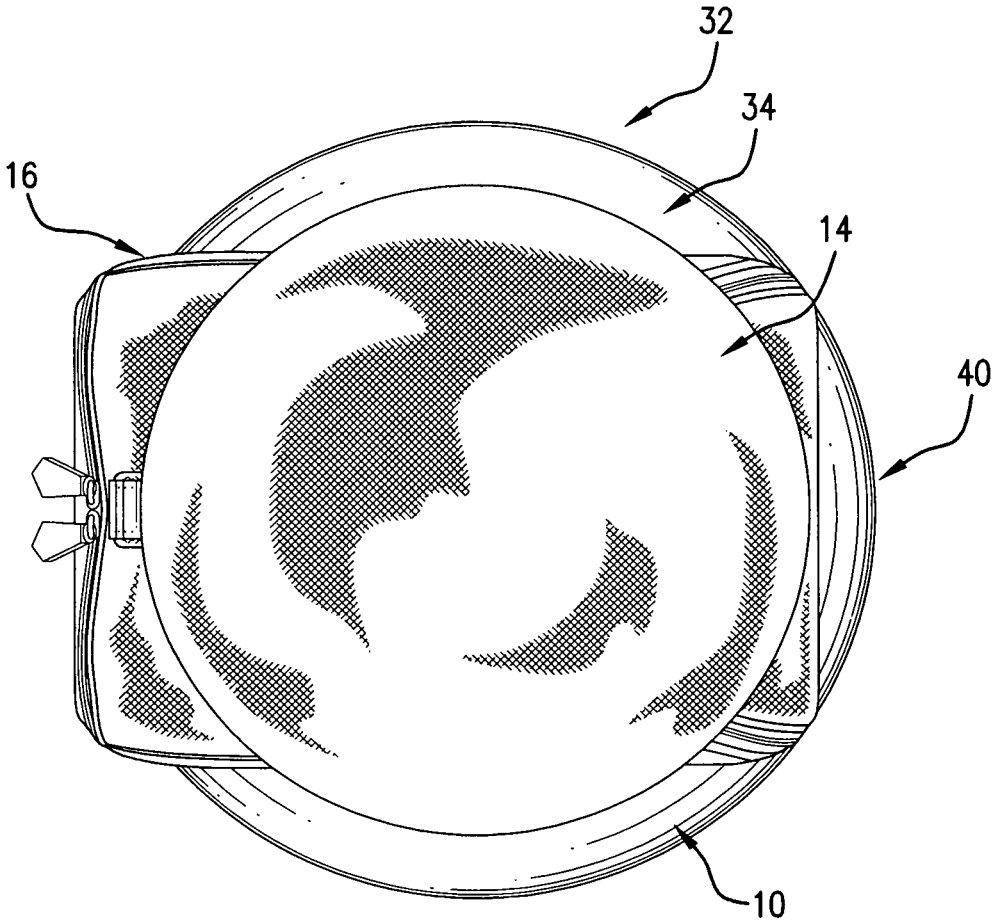
FIG. 6 is a top view of the Golf Bag Stool of FIG. 1.
Figure 7:
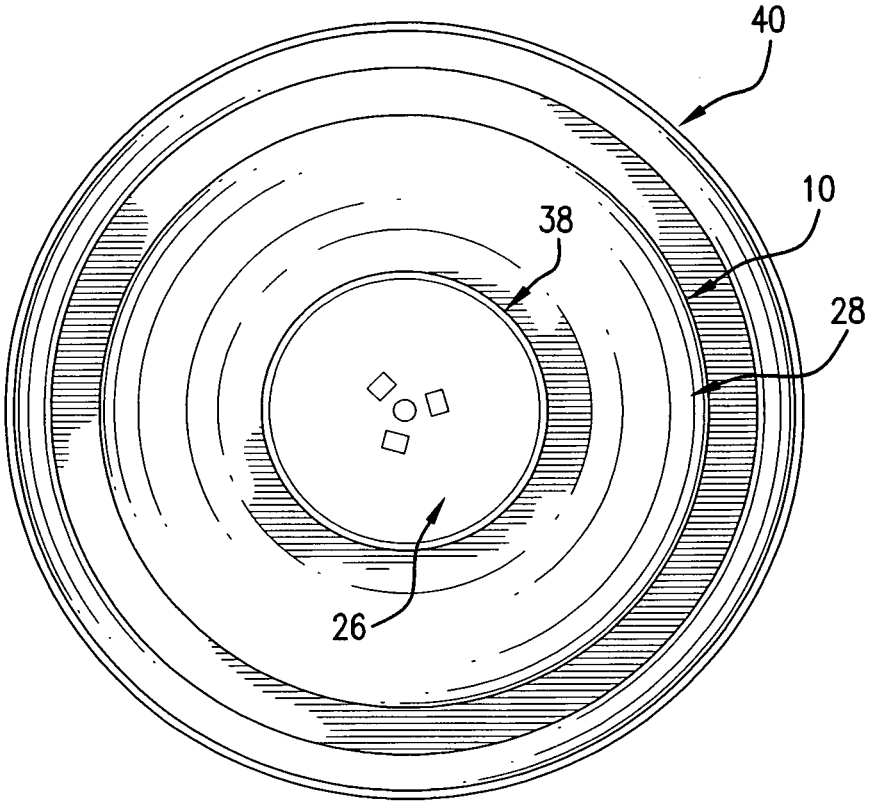
FIG. 7 is a bottom view of the Golf Bag Stool of FIG. 1.
Figure 8:
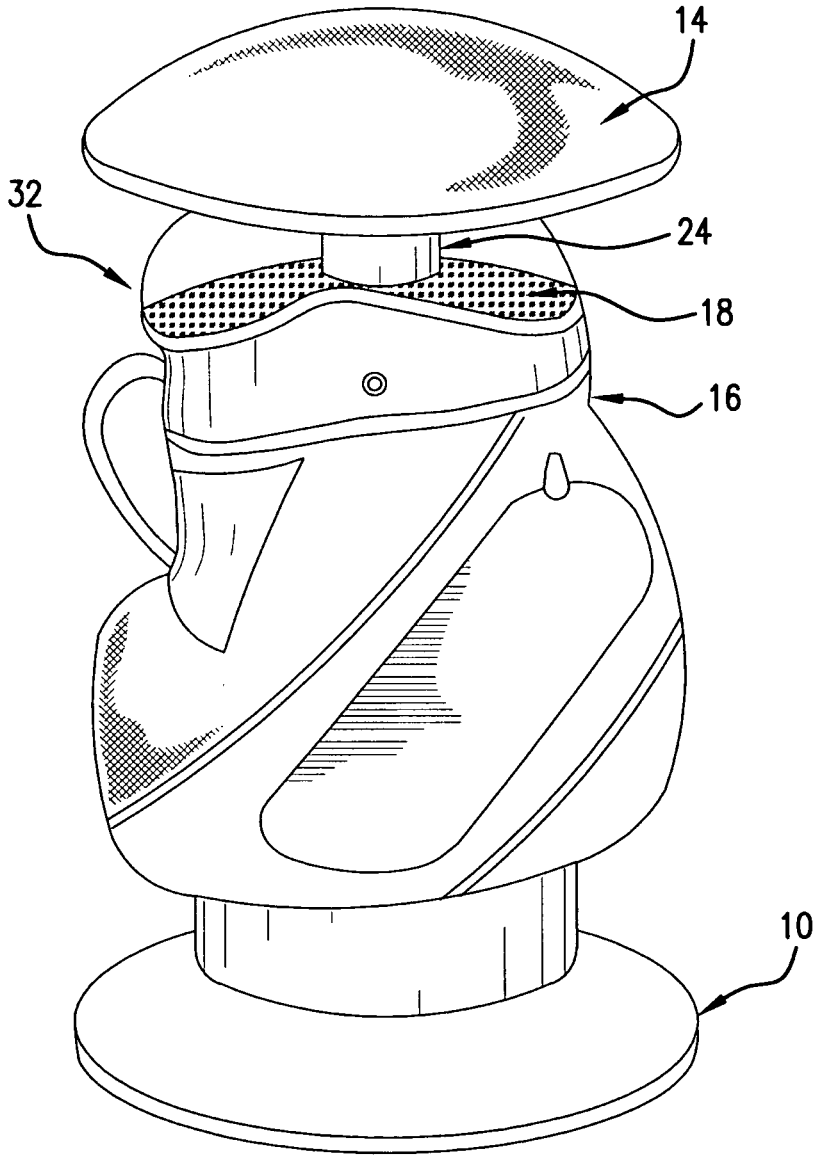
FIG. 8 is a side elevation view of an embodiment of the Golf Bag Stool.

Referring to the drawing figures, golf bag stool (32) described herein comprises a base (10), as shown in FIGS. 2 and 4, a central vertical column (12) having a top vertical column portion (24) and a bottom vertical column portion (26), a seat (14), a miniature golf bag (16), a miniature golf bag top cover (18), and a miniature golf bag bottom cover (20). The base (10) can have any shape adapted to securely stand vertical column (12). For example, base (10) can have outwardly radiating leg components to provide stability. Preferably, as shown in FIGS. 2-5 and 7, base (10) is circular and has a flat bottom portion (26) at the center thereof with a flat bottom portion circular inner perimeter (38) and upwardly tapered sides (28) extending from the circular inner perimeter of the base flat bottom portion (26) to the outer perimeter (40)

of base (10) so that the golf bag stool (32) can tip in any circumferential direction while still maintaining miniature golf bag (16) and central vertical column (12) in axial alignment. Base (10) can also have a downwardly extending side (34) to provide a cover. Vertical column (12) can be secured to base (10) by any conventional attachment devices such as screws, clamps and the like. Preferably, central vertical column (12), is secured to base (10) by providing an opening in a top portion of base (10) of approximately the same size or slightly smaller size and shape as the cross sectional dimension of bottom vertical column portion (26) of central vertical column (12) so that central vertical column (12) can fit snugly into base (10) via a friction fit. Preferably, the perimeter of vertical column (12) and the perimeter of the central opening in the top portion of base (10) are both circular.

As shown in FIGS. 2-5, miniature golf bag (16) is positioned immediately above base (10) and can rest thereon. Miniature golf bag (16) surrounds central vertical column (12) so that central vertical column (12) is centrally positioned along the vertical longitudinal axis (36) of miniature golf bag (16). To maintain this longitudinal centricity, top cover (18) of miniature golf bag (16) and bottom cover (20) of miniature golf bag (16) each have central openings, preferably circular, for receiving central vertical column (12). To securely position miniature golf bag (16) around vertical column (12) at least one, and preferably a plurality of screws or bolts (30) fasten miniature golf bag (16) to the sides of top cover (18), and bottom cover (20).

Miniature golf bag (16) can have any golf bag shape, albeit of smaller or miniature dimension. Preferable, miniature golf bag (16) can be a replica of a conventional golf bag, so that the golf bag reminds one of the game of golf. In this manner, golf bag stool (32) can be small enough to be compatible with conventional tables and countertops, but still have a golf bag shape. To make miniature golf bag (16) appear more like a conventional golf bag, miniature golf bag (16), can have pockets and zippers like the pockets and zippers used in conventional golf bags for holding tees, golf balls, pencils, turf repair tools, and score cards. Miniature golf bag (16) can have other attributes normally associated with conventional golf bags, such as insignia to show the name of the golf bag brand, or alternatively, insignia representing the identity of a local establishment such as a golf club, the name of a favorite sports team or other market, the name or names of a favorite university or tournament, the name of a favorite golfer, etc.

The total height of the golf bag stool (32) is small enough to fit under a conventional table or countertop. Preferably, golf bag stool (32) is about 28 inches in overall height from the bottom of base (10) to the top of seat (14), and has an outside diameter about 11 inches wide. In contrast, a conventional golf bag is a much larger in dimension, typically about 36 inches high, making seating atop a conventionally sized golf bag not suitable for use with conventional tables or countertops. Thus, the present invention provides a user with a reminder of golf, while still being adapted for use as conventional seating. In addition, the present invention does not rely on sitting atop a golf bag itself and the difficulties incident thereto. Instead, a sturdy and more comfortable structure is provided without the need for relying on the golf bag as the supporting structure and without the need for a step or additional steps, or other structure, that might be required for sitting on a conventional golf bag. Golf bag (32) can be comprised of any conventional materials such as leather, fabric, plastic, combinations thereof, and the like.

Central vertical column (12) is preferably circular in cross section and is positioned through the entire length of the golf bag (16) along longitudinal central axis (36) of miniature golf bag (16). Central vertical column (12) can be made of any material suitable for holding the weight of a seated person. For example, vertical column (12) can be a pole made of metal or plastic. Preferably, central vertical column (12) can comprise a pneumatic or fluid spring member having a tubular housing which can serve as the supporting column for golf bag stool (32), with a piston rod and fluid spring member mounted in the vertical column. Top vertical column portion (24) of central vertical column (12) can fit pneumatically into bottom vertical column portion (26). In this manner, the top vertical column portion (24) can pneumatically fit into bottom vertical column portion (26) and rotate 360° within bottom vertical column portion (26) so that the user can turn 360° when seated. Any of a wide array of devices can be used to comprise central vertical column (12), such as the pneumatic devices disclosed in U.S. Pat. Nos. 3,711,054; 4,485,996; 3,891,270 and 4,720,068, each of which are incorporated herein by reference.

Referring again to FIG. 2, seat (14) is attached to central vertical column (12), more particularly to the top vertical column portion (24) of vertical column (12), to provide comfortable seating for golf bag stool (32). Seat (14) can be any shape suitable for seating such as flat or curved. Preferably, as shown in FIGS. 2-5, seat (14) can be hemispherical in cross section and can be made of a soft cushioning material such as plastic or foam, with a fabric cover. Seat (14) can be attached atop central vertical column (12) by any conventional means such as by screws clamps, or by way of a friction fit. It will be seen that since top vertical column portion (24) can rotate 360°, seat (14) which is attached thereto, can also rotate universally 360° to enable a seated person to freely turn without rotating, or the need to rotate, miniature golf bag (16). Alternatively, seat (14) can be adapted to swivel around vertical column (12). And, as indicated above, since the base (10) has upwardly tapered sides (28) a person seated can also tilt the golf bag stool (32) while sitting and/or rotating.

Base (10) which includes flat bottom portion (26), upwardly tapered sides (28) and downwardly extending side (34), can be made as a unitary structure, or, alternatively, the different portions of base (10) can be made separately and fitted together. Base (10) can be fabricated of any conventional material such as plastic.

It would be desirable, to provide means for preventing unwanted slipping or sliding of golf bag stool (32) in use. Accordingly, base (10) can be provided with a roughened surface to promote greater frictional contact with a floor. Alternatively, a frictional member, such as a thin pad, made, for example, of vinyl or rubber, can be affixed by conventional means to the bottom of flat bottom portion (26) and optionally onto upwardly tapered sides (28). The thin pad can be provided with dimples, or other surface structure, to promote greater frictional contact with the floor and even greater protection against unwanted slipping or sliding of golf bag stool (32).

It will be seen that the golf bag stool (32) of the invention provides a device readily used in association with the game of golf. The device provides the user with a comfortable stool while providing the user with the impression of sitting on a conventional golf bag. Advantageously, the golf bag stool of the invention is particularly suited for seating at conventional tables and countertops.

Although the present invention has been described with references to preferred embodiments thereof, many manufactures and alternatives can be made within the context of the present invention.

The invention claimed is:

1. A golf bag stool, comprising:

a base having a top portion, a flat bottom portion, upwardly tapered sides and an outer perimeter, with said top portion of said base having a central opening, said flat bottom portion of said base having an inner perimeter, and said upwardly tapered sides of said base, extending from said inner perimeter to said outer perimeter;

a central vertical column of approximately the same cross sectional dimension as said central opening in said top portion of said base, so that said central vertical column fits into said base via a friction fit;

a miniature golf bag having a bottom cover and a top cover, said bottom cover and said top cover of said miniature golf bag each having central openings;

said central vertical column extending through said central opening of said bottom cover of said miniature golf bag and through said central opening of said top cover of said miniature golf bag so that said miniature golf bag is positioned to surround said central vertical column, with said central vertical column positioned along a longitudinal central axis of said miniature golf bag;

said central vertical column being comprised of a pneumatic device having a top vertical column portion pneumatically fitting into a bottom vertical column portion, said bottom cover of said miniature golf bag positioned immediately above said base; and a seat attached to said top vertical column portion of said central vertical column.

2. The golf bag stool of claim 1 wherein said central vertical column, said central opening in said top portion of said base, said central opening of said bottom cover of said miniature golf bag and said central opening of said top cover of said miniature golf bag are all circular.

3. The golf bag stool of claim 1 wherein said inner perimeter of said flat bottom portion of said base is circular, said outer perimeter of said base is circular and said upwardly tapered sides extend from said inner perimeter of said flat bottom portion of said base to said outer perimeter of said base so that said golf bag stool can tip in any circumferential direction while still maintaining said miniature golf bag and said central vertical column in axial alignment.

4. The golf bag stool of claim 1 wherein said top vertical column portion of said central vertical column rotates 360° in said bottom vertical column portion of said central vertical column.

5. The golf bag stool of claim 1 wherein said base is provided with a frictional member at the bottom thereof to reduce unwanted slipping.

6. A golf bag stool, comprising:

a base having a top portion, a flat bottom portion, upwardly tapered sides and a circular outer perimeter, with said top portion of said base having a central opening, said flat bottom portion of said base having a circular inner perimeter, and said upwardly tapered sides of said base, extending from said circular inner perimeter to said outer perimeter;

a central vertical column circular in cross section of approximately the same cross sectional dimension as said circular opening in said top portion of said base, so that said central vertical column fits into said base via a friction fit;

a miniature golf bag having a bottom cover and a top cover, said bottom cover and said top cover each having a circular central opening;

said central vertical column extending the entire length of said miniature golf bag through said central opening of said bottom cover of said miniature golf bag and through said central opening of said top cover of said miniature golf bag so that said miniature golf bag is positioned to surround said central vertical column and said central vertical column is positioned along a longitudinal central axis of said miniature golf bag;

said central vertical column comprising a pneumatic device having a top vertical column portion and a bottom vertical column portion, with said top vertical column portion of said central vertical column pneumatically fitted into said bottom vertical column portion;

said top vertical column portion of said central vertical column adapted to rotate 360° in said bottom vertical column portion of said central vertical column;

said bottom cover of said miniature golf bag positioned immediately above said base;

a seat attached to an upper end of said top vertical column portion of said central vertical column; and said golf bag stool being adapted to tip in any circumferential direction while still maintaining said miniature golf bag and said central vertical column in axial alignment.

* * * * *